US008997843B2

(12) United States Patent
Cipriani

(10) Patent No.: US 8,997,843 B2
(45) Date of Patent: Apr. 7, 2015

(54) CONFINEMENT GROUP FOR A PLATE HEAT EXCHANGER, A METHOD OF OBTAINING SUCH AN EXCHANGER, AND A METHOD OF ABSORBING STRESS IN A CONFINEMENT GROUP FOR PACK-TYPE PLATE HEAT EXCHANGERS

(76) Inventor: Luca Cipriani, Verona (IT)

( * ) Notice: Subject to any disclaimer, the term of this patent is extended or adjusted under 35 U.S.C. 154(b) by 927 days.

(21) Appl. No.: 13/171,737

(22) Filed: Jun. 29, 2011

(65) Prior Publication Data

US 2012/0000638 A1 Jan. 5, 2012

(30) Foreign Application Priority Data

Jul. 1, 2010 (IT) ..... VR2010A0132

(51) Int. Cl.

*F28F 9/00* (2006.01)
*F28D 9/00* (2006.01)
*F28F 3/08* (2006.01)

(52) U.S. Cl.

CPC ..... *F28D 9/0006* (2013.01); *F28F 9/001* (2013.01); *F28F 2255/14* (2013.01); *F28F 2225/08* (2013.01); *F28F 2225/02* (2013.01)

(58) Field of Classification Search

CPC ..... F28F 9/001; F28F 9/005; F28F 9/0132; F28F 9/0075; F28F 2225/02; F28F 2225/08; F28F 2225/14; F28F 2275/14; F28D 9/0006
USPC ..... 165/67, 166, 167, 170, 81, 82, 152–153
See application file for complete search history.

(56) References Cited

U.S. PATENT DOCUMENTS

| | | | | |
|---|---|---|---|---|
| 1,874,054 | A * | 8/1932 | Levinsen | 165/167 |
| 2,379,671 | A | 7/1945 | Wetherby-Williams | |
| 3,568,765 | A * | 3/1971 | Konrad | 165/166 |
| 4,596,285 | A * | 6/1986 | Dinulescu | 165/82 |
| 4,805,695 | A * | 2/1989 | Ishikawa et al. | 165/166 |

(Continued)

FOREIGN PATENT DOCUMENTS

DE 2943010 A1 5/1980

(Continued)

OTHER PUBLICATIONS

European Search Report dated Mar. 16, 2011, issued in connection with corresponding Italian priority application No. IT VR20100132.
Written Opinion in Italian dated Jul. 1, 2010, issued in connection with corresponding Italian priority application No. IT VR20100132.

*Primary Examiner* — Tho V Duong
(74) *Attorney, Agent, or Firm* — Ostrolenk Faber LLP

(57) ABSTRACT

The present disclosure relates to a confinement group for a pack-type plate heat exchanger including at least one pair of end heads (2) designed to be located one opposite to the other with respect to the plate pack and to be tightened against the plate pack by means of tightening means (5, 8), the confinement group including at least one end head (2) of the pair of heads (2), which comprises: a block (3) made of a first material resistant to compression stress and having an internal front portion (3*a*) designed to contact the plate pack, an external front portion (2*a*, 2*b*) on which the tightening means (5, 8) are designed to act, and at least one reinforcement element (4, 40) made of a second material resistant to traction stress and located at the external front portion (2*a*, 2*b*).

10 Claims, 5 Drawing Sheets

(56) References Cited

U.S. PATENT DOCUMENTS

| | | | | |
|---|---|---|---|---|
| 5,033,543 | A * | 7/1991 | Nilsson et al. | 165/166 |
| 6,098,701 | A * | 8/2000 | Blomgren | 165/67 |
| 8,104,531 | B2 * | 1/2012 | Tochon et al. | 165/11.1 |
| 2004/0112580 | A1 * | 6/2004 | Jonsson et al. | 165/167 |

FOREIGN PATENT DOCUMENTS

| | | | |
|---|---|---|---|
| FR | 2716960 | A1 * | 9/1995 |
| GB | 1364705 | A * | 8/1974 |
| GB | 2054819 | A | 2/1981 |
| WO | WO 2010/036183 | A1 | 4/2010 |

* cited by examiner

CONFINEMENT GROUP FOR A PLATE HEAT EXCHANGER, A METHOD OF OBTAINING SUCH AN EXCHANGER, AND A METHOD OF ABSORBING STRESS IN A CONFINEMENT GROUP FOR PACK-TYPE PLATE HEAT EXCHANGERS

FIELD OF INVENTION

The present invention relates to a confinement group for a plate heat exchanger, a plate heat exchanger including such a confinement group, and a method of obtaining a confinement group.

BACKGROUND OF THE INVENTION

A conventional inspectable plate heat exchanger comprises a plurality of plates kept tightened and packed together by a plurality of tie rods extending between a pair of side plates having a suitable thickness. More particularly, a plurality of through holes are formed in the two side plates, each through hole in a side plate being aligned, in use, with a respective through hole formed in the other side plate, a respective tie rod being inserted in each pair of aligned holes.

Each plate of the exchanger is suitably shaped, in such a way as to delimit, on one side, a channel extending at the edge of the plate and designed to receive a gasket. The channel has two side sections, substantially parallel with one another, and two sections, one being delimited at the top and the other at the bottom of the plate, which extend in a substantially diagonal direction and are designed to connect the two side sections.

Fluids at a different temperature one with respect to the other are then alternatingly supplied between adjacent pairs of plates, thereby obtaining heat exchange therebetween, whereas the gaskets received in the channels or recesses ensure the seal between the plates.

As it is known, a plate heat exchanger correctly performs its function when the plates are kept packed and pressed together, and the seal gaskets are seated in position, thereby preventing fluid leakages, which, as it will be understood, would cause pressure drops, and thus a decrease in heat exchange efficiency.

It is worth noting that once the plates have been packed together, the side sections of the gaskets in adjacent plates are, as a matter of fact, substantially aligned with one another, whereas this is not the case with the diagonal sections of the same gaskets, which can result in a poorer seal at the upper and lower, in use, portions of the exchanger, i.e. where the seal of the exchanger is obtained by the diagonal sections of the gaskets. It is therefore imperative to be able to suitably compress the gaskets.

It has been evaluated that a collapsed or fluid leakage zone in conventional inspectable plate heat exchangers, more particularly heat exchangers of large size, is usually an intermediate portion between the lower and the upper portion.

Moreover, the two side plates arranged to keep the plate pack tightened have a lower resistance at the intermediate portions of the exchanger.

As it is known, in fact, the two side plates are usually made of carbon steel and have a thickness up to 60 mm or more, as a function of the pressure which they are designed to apply to the exchanger plate pack and of the size of the plate pack. The pair of side plates are tighten by means of tie rods having threaded ends engaged by a respective tightening nut, in such a way as to obtain a degree of tightening or compression for the seal gaskets suitable for preventing, in use, fluid leakages that would result in load losses, i.e. for keeping the fluids flowing through the plate pack at a predetermined operation pressure.

The international application WO-2010/036183 teaches a heat exchanger provided with, among the other things, a side plate having a base plate and a connecting part with an external curved wall extending from an intermediate portion of the base plate. According to such a document, a connection part thus-shaped is intended to provide the side plate with a sufficient space for allowing the heat exchanger connections that, should a flat side plate be used, could not be implemented. In the same document, it is further stated that the base plate can be provided with portions having a greater thickness, thereby withstanding high stress, and the base plate and the connecting part can be obtained by casting, moulding, etc., and thus the connecting part is obtained integral with the base plate.

U.S. Pat. No. 2,379,671 teaches a side plate for heat exchangers, made in one piece that can include a flat internal portion and a substantially curved external portion with concavity facing towards the inside of the exchanger.

The German patent application DE-29 43 010 teaches a heat exchanger provided with a side plate made in one piece and provided with a base plate and external stiffening elements.

The UK patent application GB-2 054 819 teaches a heat exchanger provided with a side plate shaped in such a way as to have external or side sections which are substantially tilted or lowered with respect to an intermediate section.

The UK patent GB-1 364 705 teaches a heat exchanger provided with side plates having a base plate and external stiffening elements welded thereto.

SUMMARY OF THE INVENTION

The main object of the present invention it to provide a confinement group for plate heat exchangers suitable for ensuring the preservation of the operation pressure at a constant value, and thus for preventing fluid leakages resulting in load losses.

Another object of the present invention is to provide a confinement group for plate heat exchangers which is suitable for keeping a heat exchanger in optimum operation conditions, even at high operation pressures.

Another object of the present invention is to provide a confinement group for heat exchangers which ensures a suitable and stable anchoring of the work fluid inlet/outlet ducts to a heat exchanger.

Another object of the present invention is to provide a confinement group for heat exchangers which is made of relatively light and cheaper materials than the side plates made of steel.

Another object of the present invention is to provide a method of adsorbing the stress in a confinement group for plate heat exchangers.

Another object of the present invention is to provide a method of obtaining a confinement group for a heat exchanger which is easy and cheap to be manufactured.

According to a first aspect of the present invention a confinement group for a pack-type plate heat exchanger is provided which includes at least one pair of end heads designed to be located one opposite to the other with respect to the plate pack and to be tightened against the plate pack by tightening means, at least one end head of the pair of heads comprising:

- a block made of a first material resistant to compression stress and having an internal front portion designed to contact the plate pack, an external front portion on which the tightening means are designed to act, and at least one reinforcement element made of a second material resistant to traction stress and located at the external front portion.

According to another aspect of the present invention a method of adsorbing stress in a confinement group for pack-type plate heat exchangers is provided, which includes at least one pair of heads designed to be located one opposite to the other with respect to the plate pack, the method comprising the following steps:

constraining at least one head along a first direction or constrain direction;

stressing the at least one head along a second direction or stress direction, thereby causing a compression stress at an internal front portion of the head, and a traction stress at an external front portion of the head;

arranging a first layer made of a first material resistant to compression stress to resist the compression stress; and arranging a second layer made of a second material resistant to traction stress to withstand traction stress.

BRIEF DESCRIPTION OF THE DRAWINGS

Further aspects and advantages of the present invention will be better appear from the following detailed description of specific embodiments of a confinement group for plate heat exchangers, the description being made with reference to the accompanying drawings, in which.

In the drawings, the same or similar parts or components were marked with the same reference numerals.

DETAILED DESCRIPTION OF THE PREFERRED EMBODIMENTS

With reference first to FIGS. 1 to 5, a pair of conventional side plates A for a heat exchanger are shown in an exaggerated deformed condition for the sake of clarity as a result of the inner operation pressures exerted thereon. Each side plate A has a substantially rectangular shape and is formed with a plurality of through holes along its main or longer sides. More particularly, the two side plates A are connected to one another by a plurality of tie rods B inserted in respective through holes formed at the main sides of the side plates A with nuts C being screwed thereto, each nut being designed to abut against, and tighten the outer surface of a respective side plate. As it is known, the plates D of the heat exchanger are packed together (plate pack) and tightened between the two side plates A.

In use, the side plates A are alternatingly subjected to traction and compression strain and stress, owing to the two fluids flowing at different pressures between the plates D of the heat exchanger.

Figure 2:
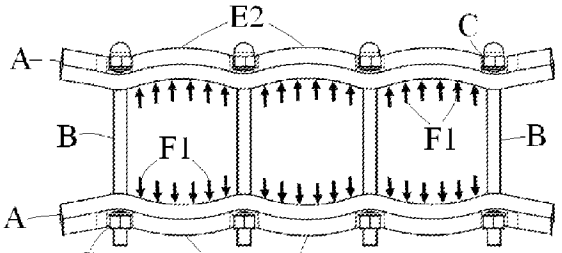
FIGS. 1 to 3 are perspective, side and front (this being on an enlarged scale), respectively, diagrammatic views, of a pair of conventional metal (steel) confinement side plates for a pack-type plate heat exchanger, which are connected with one another by tie rods and shown in a deformed (convex) condition due to inner operation pressures.
Figure 3:
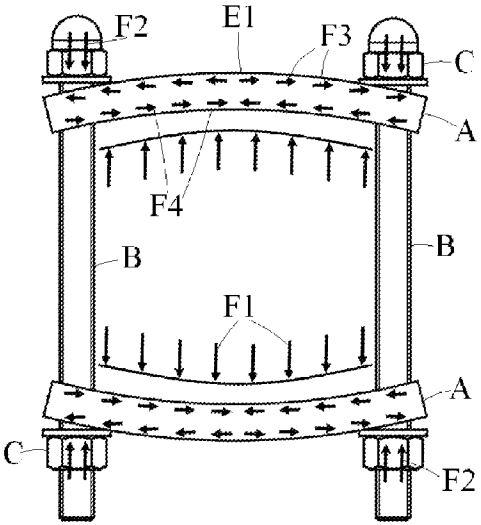

With particular reference to FIGS. 2 and 3, arrows F1 have been used to indicate the stress forces applied to the inner surface of the side plates A by the fluids supplied in the heat exchanger, arrows F2 to indicate the constrain force/s applied by the nuts C on the outer surface of the side plates A, arrows F3 to indicate the traction components obtained by the distribution of stress forces inside the side plates A, and, more particularly, on the outer, in use, face of the side plates A, and arrows F4 to indicate the compression components obtained by the distribution of stress forces within the side plates A and, more particularly, on the inner, in use, face of the side plates A.

As it is known, steel used to obtain the side plates A of heat exchangers is a material mainly resistant to traction stress, and thus the compression component F4 due to the action of the stress forces F1 within the side plates, is not suitably adsorbed and withstood, and this jeopardizes flatness of the side plates, which become then curved or anyway deformed in an imperceptible manner to a naked eye, although extremely dangerous for the heat exchanger remaining fluid tight.

Moreover, as it will be understood, the maximum deformation due to the compression component of the stress forces exerted on the side plates A is to be found at the zones far from, or at an intermediate distance between two tie rods B.

The fluids forced to flow throughout the exchanger will then cause maximum deformation of the side plates along a zone E1 longitudinally or parallely extending with respect to the main or longer sides of a side plate and at an intermediate position between the two sides or flanks of the same side plates, and along zones E2 extending transversely, or from one side to the other of each side plate A and in an intermediate position between adjacent tie rods B.

Owing to such deformations, an undesirable effect (see in particular FIG. 4) is then obtained, i.e. each plate of the plate pack deforms in such a way as to have its concavity facing towards its respective passage zone of the fluid at a higher pressure HP and a convexity facing towards its respective passage zone of the fluid at a lower pressure LP. As a consequence of this:

a) the passage section for the fluid at a higher pressure HP is increased with respect to the design section, and this results in a reciprocal moving away of the receiving seats for the gaskets at the zone between adjacent plates in which the fluid at a higher pressure is supplied, with consequent loss of tight sealing and leakages; whereas b) the passage section for the fluid at a lower pressure LP becomes reduced with respect to the design section, and thus a throttling is formed in the passage section of the fluid at a lower pressure, with consequent, even substantial, load losses.

As it will be easily understood, such deformations jeopardize the heat exchange efficiency of the heat exchanger.

Figure 5:
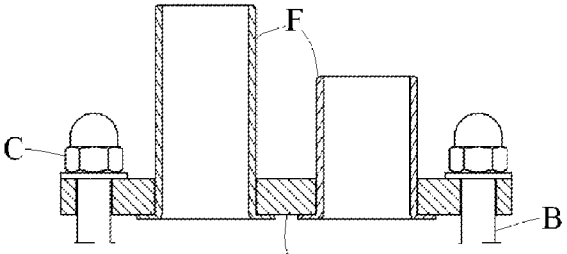
FIG. 5 is a cross section view of a conventional end side plate for plate-pack heat exchangers, to which fluid inlet/outlet ducts are secured.
Figure 4:
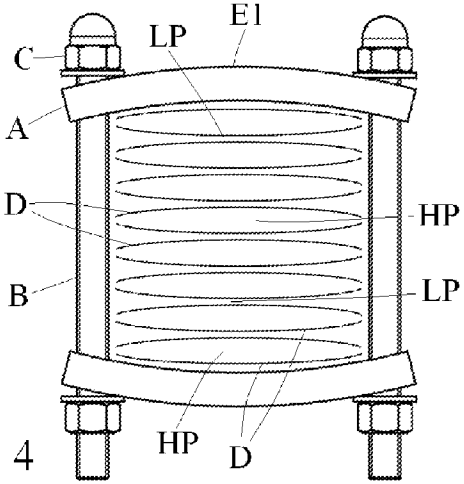
FIG. 4 is a diagrammatic view similar to FIG. 3 of a pair of conventional side plates between which a plate pack is located, the plates being shown in a deformed condition reached as a result of the inner operation pressures.
Figure 1:
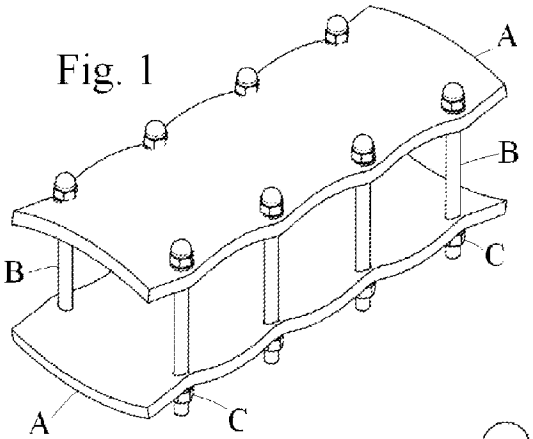

With reference to FIG. 5, sleeves or pipe unions F for the inlet-outlet of fluids used in a heat exchanger are shown, which are seated in the conventional side plates A. As it can be noted, such pipe unions F have a rather marked portion overhanging from the respective side plate A, and thus, should such pipe unions be subjected to accidental impacts, e.g., during the heat exchanger assembling or transport steps, they are liable to deformations which could jeopardize the structural integrity of the plates and even of the pipe unions, that would require replacement of the damaged components.

Figure 7:
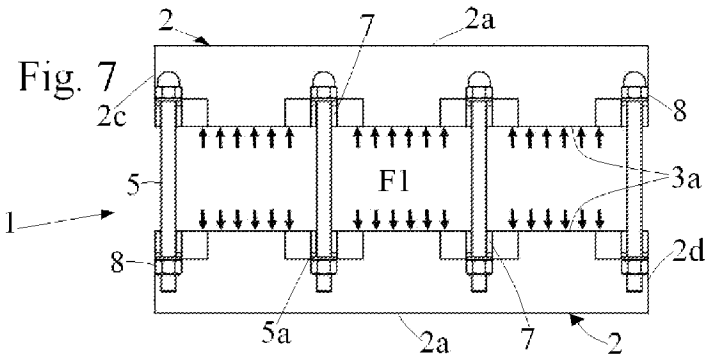
FIGS. 6 to 8 are perspective, side and front (this being on an enlarged scale), respectively, diagrammatic views, of a confinement group for a pack-type plate heat exchanger according to a first embodiment of the present invention.
Figure 10:
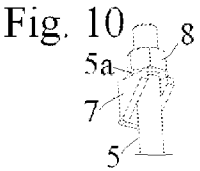
FIGS. 10 to 12 are perspective views of a detail of a connection seat of a respective tie rod, the seat being formed in a confinement group according to the present invention.
Figure 11:
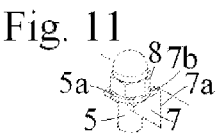
Figure 12:
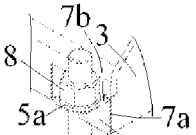
Figure 9:
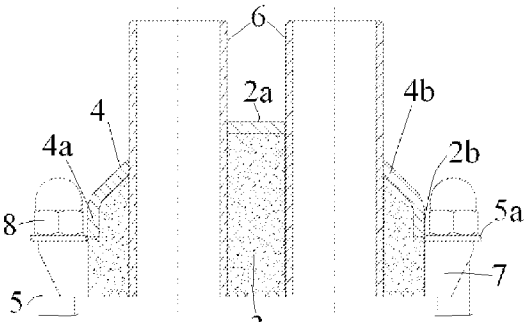
FIG. 9 is a cross section view of a confinement group according to FIGS. 6 to 8, in which fluid inlet/outlet ducts are inserted and secured.
Figure 6:
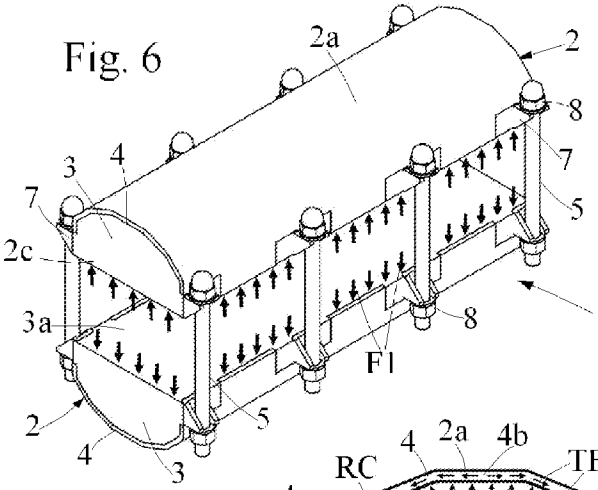
Figure 8:
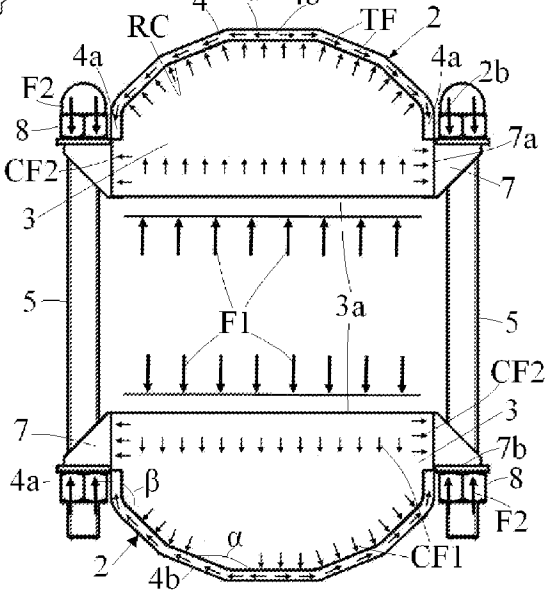

FIGS. 6 to 8 show a confinement group 1 for plate-pack heat exchangers (not shown in these Figures) according to the present invention, which includes a pair of end heads 2 designed to be located at opposite ends with respect to the plate pack and to be tightened against the plate pack by tightening means, e.g. comprising tie rods 5 having threaded ends and nuts 8 screwable onto the ends thereof.

According to the present invention, at least one end head 2 of the pair of heads 2 comprises:

- a block 3 made of a first material resistant to compression stress and having an internal front portion, preferably a substantially flat inner surface 3*a* designed to contact the plate pack,
- an external front portion 2*a*, 2*b*, on which the tightening means are designed to act, and
- at least one reinforcement element 4 made of a second material resistant to traction stress and located at the external front portion 2*a*, 2*b*.

The first material differs from the second material.

Advantageously, should the internal surface 3*a* be substantially flat, seats for the tie rods having an axis substantially orthogonal to the inner surface 3*a* are provided for.

More particularly, each head 2 includes two base surfaces, front surface 2*c* and rear surface 2*d*, whereas the external front portion typically comprises a shell having an outer surface 2*a* and two sides 2*b*.

Advantageously, the first material suitable for resisting to compression stress is made of a material selected from the group including concrete, wood, resin, plastics material, concrete mixed with pumice, expanded clay, lava lapillus, foamed polystyrene beads or a combination thereof, whereas the second material suitable for resisting to traction stress is made of a material selected from the group including carbon steel, stainless steel, carbon, Kevlar, and the like.

If desired, an outer reinforcement can be provided for, such as a grid or one or more enveloping stirrups or any other suitable head stiffening means, such as nets or grids, as will be also stated hereinbelow with reference to other embodiments of a confinement group according to the present invention.

According to the embodiment shown in FIGS. 6 to 9, the reinforcement element comprises a shell element 4 located at the external front portion 2*a*, and advantageously at the sides 2*b* of a head 2, and more particularly as a "closure" of its respective head.

Advantageously, each head delimits seats for the tightening means, e.g. tie rods 5 belonging to the tightening means, whereas the shell element 4 has:

- lateral end portions 4*a*; and
- an intermediate portion 4*b* connecting the lateral portions 4*a*, thereby delimiting therewith a receiving zone RC for the block 3.

The intermediate portion 4*b* can comprise one, two or a plurality of sections (a plurality of sections in FIGS. 6 to 8) inclined one with respect to the other in such a way that adjacent sections delimit therebetween an obtuse or right angle $\alpha$ facing towards the internal front portion 3*a* of its respective head 2. Preferably, the end sections of the intermediate portion 4*b* are inclined with respect to the respective lateral end portion 4*a*, thereby delimiting therewith an obtuse or right angle $\beta$ facing towards the internal front portion 3*a*.

According to this embodiment, the block 3 made of a material resistant to compression stress will then extend from the inner surface 3*a* up to the internal, in use, wall of the shell element 4.

Advantageously, the block has a thickness which can range between 60 and 220 mm, whereas the reinforcement element has a thickness that can range between 3 and 10 mm.

One or more ducts or pipe unions 6 for fluid inlet/outlet in/from the exchanger are also provided, which are wholly buried in a head 2, and, more particularly, they extend both throughout the block 3 and the reinforcement element 4 (see FIG. 8)

The seats for the tie rods can, instead, be obtained directly from the reinforcement element 4, which, at its lateral end portions 4*a*, has pairs of projections or ears 7 parallel with one another, and designed to act as abutment shoulders for a respective washer 5*a*, which is mounted on a tie rod 5. A nut 8, which is in screwing engagement with a threaded end of a respective tie rod 5, is designed to abut and press the washer 5*a*. The ears 7 preferably extend at an angle of 90° relatively to the respective lateral end portion 4*a* and have, for example, a substantially parallel trim with respect to the front 2*c* and rear 2*d* base surfaces. As it will be understood, the ears 7 are relatively simple to be obtained and furthermore the tie rods 5 can be housed therein in work position in a rapid and easy way, since, as a matter of fact, the ears 7 delimit outwardly open seats contrary to the through holes formed in the conventional side plates A.

Each ear 7 then has a face or surface 7*b* to be engaged by a respective tightening means, more particularly by the washer 5*a*, on which the nut 8 is to be tightened, and an internal, in use, face or surface 7*a*, designed to abut against the block 3 and extending, substantially parallel to the tie rods 5 according to the embodiment shown. The two faces or surfaces 7*a*, 7*b* can be, for example, tilted with respect to one another of about 90°.

Advantageously, the block 3 extends in such a way as to wholly or partly engage the wall 7*a*. Owing to such expedient, the block 3 withstands, in use, any deformations of the ears 7 due to the action exerted thereon by the nuts 8 tightened on the tie rods 5.

To mount a plate heat exchanger, a plate pack and a confinement group 1 having two heads 2 are arranged. The two heads are then located one opposite to the other with respect to the plate pack, each head 2 having its internal front 3*a* facing towards, and close to the plate pack. At this point, tie rods 5 are inserted into respective seats provided in the heads 2, in such a way that the longitudinal axis of each tie rod is, preferably, substantially perpendicular to the internal fronts 3*a*, the washers 5*a* are mounted on the tie rods 5, and the nuts 8 are then screwed onto the threaded ends of the tie rods so as to bring them in abutment against a respective washer 5*a* and to tighten them against a respective head 2, and thus against the plate pack.

Each head 2 of a confinement group according to the present invention is obtained by a manufacturing method comprising the following steps:

- arranging a reinforcement element 4 made of a material resistant to traction, e.g. shaped as a channel,
- locating the channel-shaped reinforcement element 4 against a flat surface (not shown in the drawings), thereby delimiting a casting cavity therewith,
- casting into the casting cavity a slurry of hardenable material resistant to compression, which upon hardening will take the shape of the channel reinforcement element 4,
- letting or causing the slurry of casted material to harden, thereby obtaining a block 3 close to the channel reinforcement element, and
- removing from the flat surface the reinforcement element 4 with the block made of hardened material thereon, thereby obtaining a head 2 provided with a substantially flat internal front portion 3*a*, ready to be used.

Advantageously, a flat plate or slab, e.g. a metallic plate or slab preferably bearing a detacher on its respective face facing towards the reinforcement element, can be applied against the channel-shaped or shell-shaped reinforcement element 4, thereby closing the channel and obtaining a casting cavity, in which slurry of hardenable material resistant to compression can be cast. Once the cast material is hardened, the plate or slab is removed, thereby obtaining a head 2 ready to be used.

Advantageously, a flat plate or slab can be used between two opposed channel reinforcement members 4 to simultaneously obtain two heads 2.

As an alternative, the slurry of hardenable material resistant to compression can be cast in a caisson or mould having shape and size corresponding to those of the channel reinforcement element 4 (apart from the ears 7) and subsequently assembled with a reinforcement element 4.

In so far as the ears or projections 7 of a reinforcement element 4 are concerned, they can be obtained in a variety of ways. If the reinforcement element is obtained, e.g. by a moulding step, also the projections 7 can be obtained by moulding. If instead the reinforcement element 4 is made of a metallic material, the projections 7 can be obtained by a working operation according to which the reinforcement element is cut, preferably after it has been suitably shaped, at its lateral end portions 4*a*, by outwardly bending reinforcement element sections corresponding to the projections 7 of about 90°, i.e. until they are substantially parallel to the front 2*c* and rear 2*d* base surfaces.

Alternatingly, the projections or ears 7 can be separately obtained and welded to the reinforcement element 4.

With a confinement group according to the present invention, the material resistant to compression, which is, as a matter of fact, an internal block 3 surrounded by its reinforcement (external) element 4, is designed to adsorb, in use, the stress or push forces F1 exerted by the pressure of the fluids flowing between the packed plates of the exchanger. The portion of stress forces or residual stress CF1 which is not adsorbed by the block 3, propagates therethrough and is applied to the reinforcement element 4. As it will be noted, the block 3 of a compression resistant material is shaped in such a way as to have a flat internal surface orthogonal to the stress forces F1 and a substantially inclined or rounded external surface, so as to ensure a distribution on a larger surface of the residual stress that will be discharged onto the tie rods as traction stress TF.

It should also be noted that, if ears 7 and a block 3 extending throughout the length (face 7*a*) of each ear 7 are provided, the compression forces CF2 propagating throughout the block 3 close to the face 7*a* of the projections 7, will oppose inwardly bending of the projections 7, which could otherwise occur if the internal front portion 3*a* of the block 3 is substantially aligned with the washers 5*a* and is not then wholly or partly co-extensive with the lugs 7.

According to the present invention, with a pressure of 400,000 N/m$^2$ exerted on the internal flat surface 3*a* of the block 3, the reinforcement element will be subjected to a stress of 400,000 N/mm$^2$ divided by the number of lugs or projections 7.

Owing to the structure of the heads 2, a confinement group according to the present invention is obtained, which is non-deformable or anyway provided with high resistance to deformations both in transversal and longitudinal directions, and suitable for keeping, in use, the plates of the plate pack substantially parallel with one another or, in any case, in a correct mutual trim, within tolerance limits which are predictable and constant as a function of the whole size of the plate pack to which the confinement group is to be applied. In the structure of a confinement group according to the present invention then the compression stress due to the stress forces F1 of the heat exchanger fluids are transformed into compression and traction stress, the compression stress being adsorbed by the block made of a compression resistant material 3, whereas the traction stress is neutralized by the traction resistant reinforcement element 4.

Figure 13:
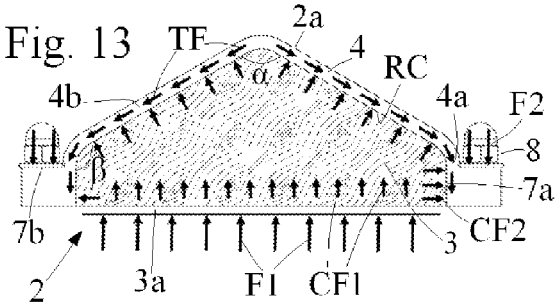
FIGS. 13 to 15 are cross section views of respective embodiments of a heat exchanger confinement group according to the present invention.

In FIG. 13 another embodiment of a head 2 for a confinement group according to the present invention is shown, which is similar to the embodiment shown in FIGS. 5 to 8, but the channel reinforcement element 4 has a substantially V-shaped cross section 4*b*, i.e. the cross section has two sections tilted with respect to one another, thereby delimiting an obtuse angle $\alpha$ therebetween.

Figure 14:
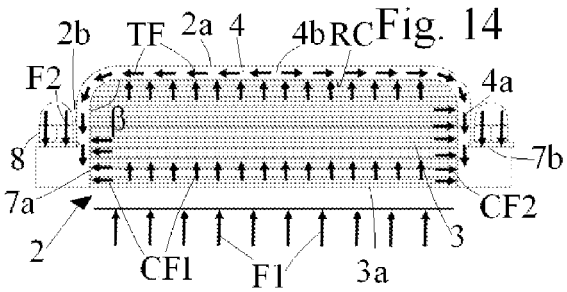

FIG. 14 shows another embodiment of a head 2 for a confinement group according to the present invention, in which the channel reinforcement element 4 has a flat bottom 4*b* flanked by two substantially parallel side walls 4*a* which are radiused with the flat bottom 4*b* and extend at a substantially right angle $\beta$ therefrom.

According to a variant (see FIG. 15), each head 2 for a confinement group according to the present invention comprises a block 3, which includes a reinforcement structure including, for example, a plurality of stiffening rods 40, or a grid including rows of connected or non-connected rods, which are preferably inclined at 90° one with respect to the other, the reinforcement being wholly or at least partly buried in the block 3 made of a compression resistant material.

The rod-like reinforcement elements 40 preferably extend from one base 2*c* surface to the other 2*d*, and are buried in the block 3 close to the external front portion 2*a* of the block itself. If desired, the rods 40 can even be located in a more inner position of the block, but preferably not beyond the middle-line of the thickness of the block, and thus preferably distal from the internal front portion 3*a* and proximal to the external front portion 2*a* to assist in ensuring structural integrity of the block 3 at the external front portion 2*a*.

According to this preferred embodiment, the block 3 of compression resistant material can have a thickness from 80 to 200 mm, whereas the traction resistant layer can have a thickness from 4 to 8 mm.

In each head 2 seats or recesses 10 for the tie rods 5 are provided which extend in a cross direction and, preferably, orthogonally from the substantially flat internal surface 3*a* to the external surface 2*a* and have a cross section slightly larger than the tie rods 5.

Figure 15:
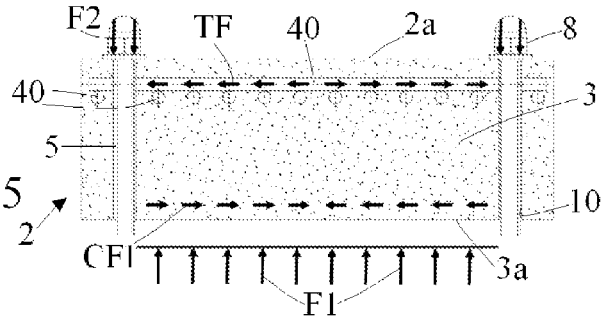

In the embodiment shown in FIG. 15, the nuts 8 abut (preferably, as stated above, with the interposition of washers 5*a*) against the external surface 2*a* of a respective head 2, and thus directly against the block of compression resistant material.

Figure 16:
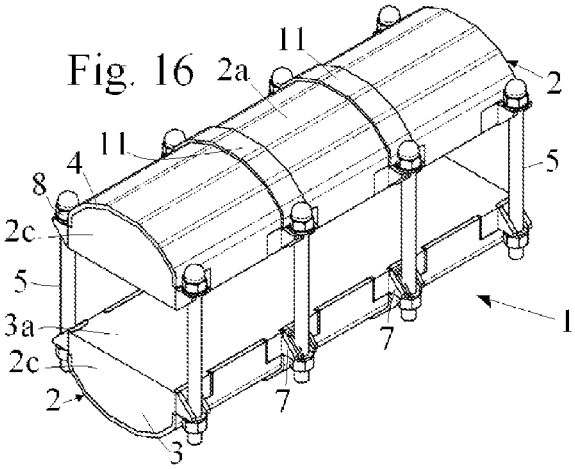
FIG. 16 is a perspective view of another embodiment of confinement group according to the present invention provided with enveloping stirrups.
Figure 17:
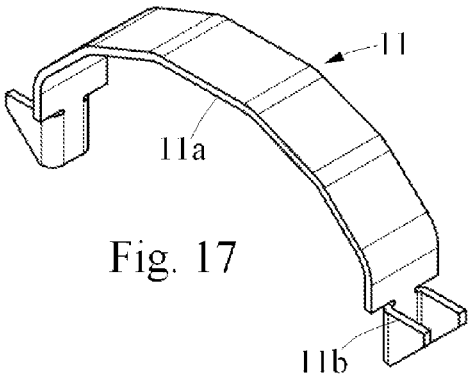
FIG. 17 is a perspective view of an enveloping stirrup for the confinement group of FIG. 16.
Figure 19:
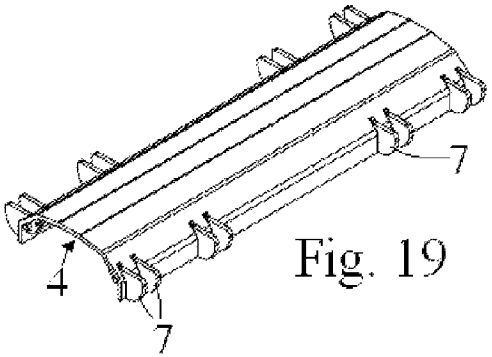
FIGS. 19 to 21 are perspective views from above, front and from below, respectively, of a reinforcement element for the confinement group of FIG. 18.
Figure 20:
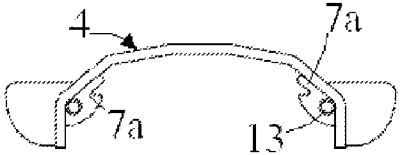
Figure 21:
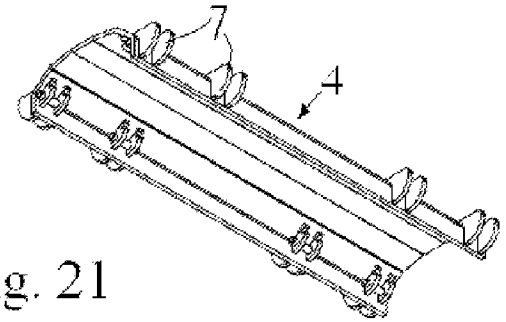
Figure 18:
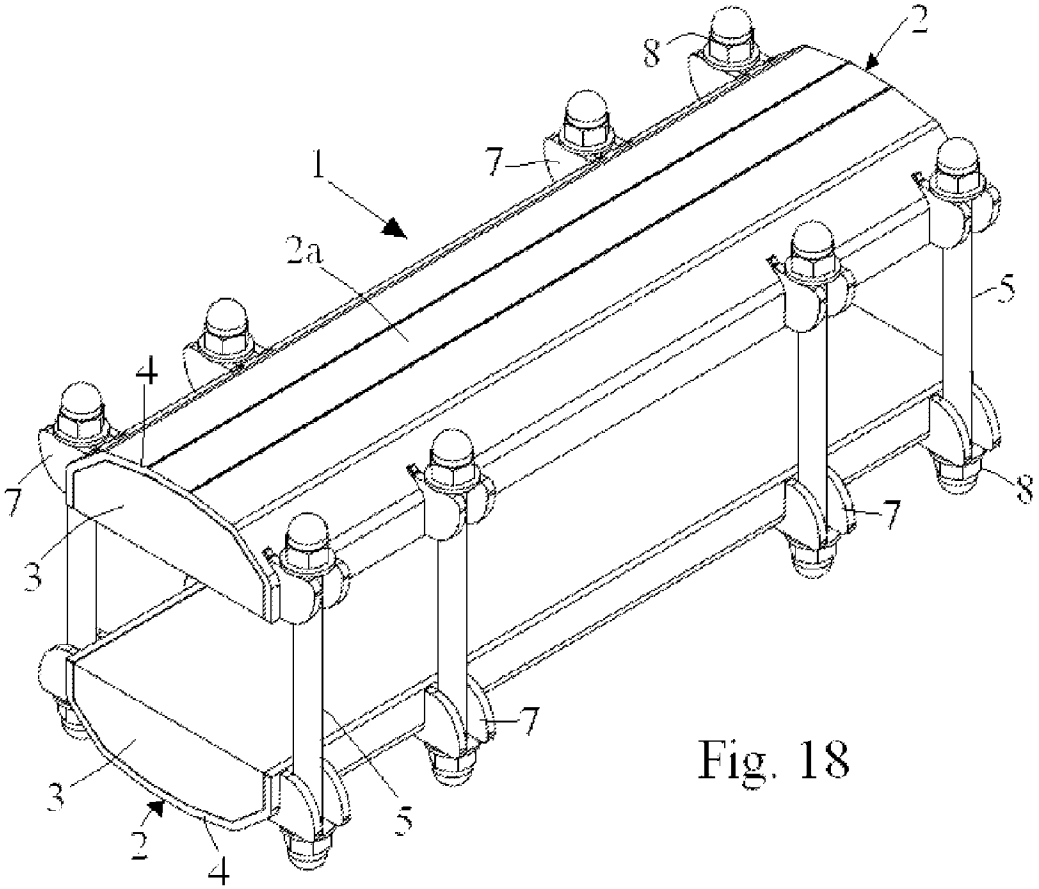
FIG. 18 is a perspective view slightly from above of another embodiment of a confinement group according to the present invention.
Figure 22:
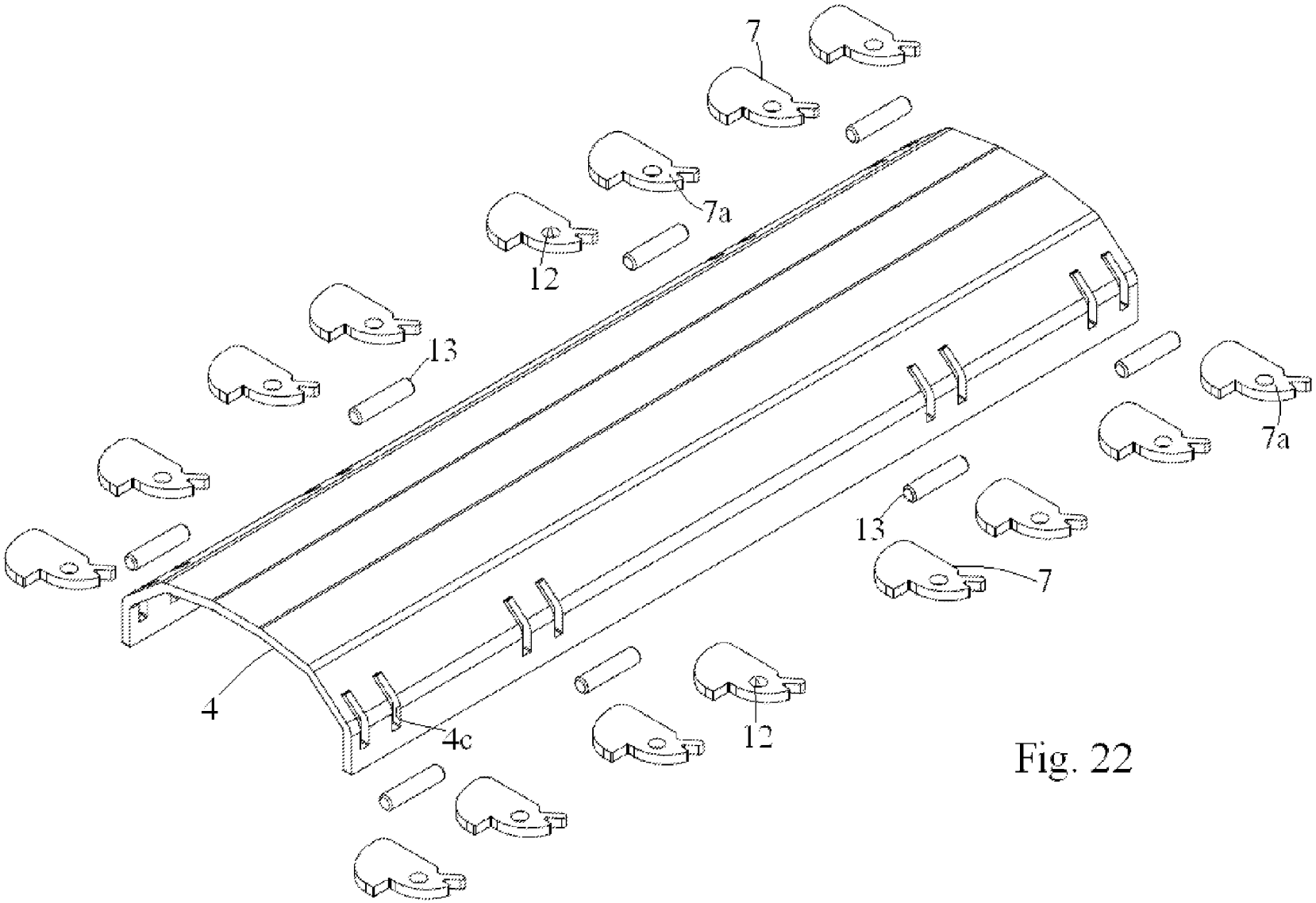
FIG. 22 is an exploded perspective view slightly from above of the reinforcement element of FIGS. 19 to 21.

Referring now to FIGS. 16 and 17, a confinement group similar to the embodiment shown in FIGS. 6 to 8 has been illustrated, which is provided with heads 2 having one or more external enveloping and strengthening stirrups 11, such confinement group being designed to be located on the external front portion 2*a*, 2*b* and to apply a supplementary confinement force to the heads themselves to withstand the deformation stress applied to the heads, and more particularly to the reinforcement members 4 by the pressurized fluids flowing throughout the heat exchanger.

More particularly, each enveloping stirrup 11 can include a main slab body 11*a* substantially shaped as a respective section of the front external portion or shell 2*a* of a head 2, in such a way as to be suitable for a shape-engagement therewith, and U-shaped ends 11*b* designed, in use, to be located in the intermediate zone between two ears 7 in which a tie rod is locatable. Upon assembling the heat exchanger, the tightening action applied by a tie rod 5 or better of a nut 8 on the ears 7, will also be applied to the end 11*b* of an enveloping stirrup and thus on the stirrup 11 itself, which is thus tightened on the remaining components of its respective head 2.

The enveloping stirrups 11 then cooperate with a respective reinforcement element 4 resistant to traction stress and with the respective block 3 of a material resistant to compression stress to withstand the deformation forces of a head, and thus to ensure that a correct trim of the plate pack of the exchanger is maintained.

With reference now to FIGS. 18 to 22, a confinement group provided with a reinforcement element 4 is shown, in which projections 7 are separately obtained and secured to the reinforcement element 4.

To this end, in the reinforcement element 4 slots 4*c* are formed into which the projections 7 can be inserted and secured in position. Advantageously, a through hole 12 can be provided in each projection 7 at a portion thereof designed to protrude inwardly in the reinforcement element 4, i.e. opposite to the tie rods 5 with respect to the reinforcement element 4. A pin 13 is also provided which can be inserted in the aligned holes of two projections 7 designed to support a respective tie rod 5. More particularly, each through hole 12, when its respective projection 7 has been inserted into the slot 4*c* of the reinforcement element 4, will be located close to the internal wall (internal in the meaning referred to above) of the reinforcement element 4 itself.

The portion of the projection 7 protruding inwardly (in the meaning referred to above) has preferably a section 7*a* shaped in such a way as to abut, in use, against a respective inner portion of the reinforcement element 4.

After the projection 7 has been inserted into the slots 4*c* of the reinforcement element 4 and the pins 13 have been inserted into the through holes 12, the block 3 will be cast onto the reinforcement element 4, thereby embedding the projections 7 in the block 3 to secure them in position.

As it will be understood, a confinement group according to the present invention makes it possible to ensure a correct tightening stable in time of the plate pack, even when the working fluids are supplied at high pressures and possibly intermittently to the heat exchanger.

On the contrary, when using conventional side plates A, the same features and the same efficiency could be obtained only by using side plates made of steel and having a large thickness, which, apart from being expensive to produce, involve major problems of handling and safety of the operators due to their weight. As it is known, with conventional plate heat exchangers relatively small in size, and operating, e.g., at pressures of 16 to 20 bar, usually side plates having a thickness from 15 to 20 mm are used, whereas when heat exchangers having rather large plates are used, and the working fluid pressure of heat exchanger being the same, the thickness of the side plates made of steel to be used to tighten the plate pack can reach 60-70 mm or more.

With a confinement group provided with heads 2 in accordance with the present invention, to maintain in time a correct trim and thus a perfect seal of the heat exchanger even at high pressures of 25-30 bar, it is sufficient that the thickness of the traction resistant material (typically steel) of the heads is about 5 mm only. It is fully evident then that, owing to the solution provided by the present invention it is possible to obtain a substantial reduction in the amount of traction resistant material, and thus a consistent reduction in costs together with a higher operation reliability in time of the heat exchanger.

In so far as the block 3 of compression resistant material is concerned, it can be obtained by using rather cheap and very light materials. In this regard, concrete comprising a mixture of pumice and cement has been found to be particularly suitable. Preferably, as a to compression resistant material a mixture including 60-75% of pumice, preferably 70%, and 25-40% of sand, preferably 30% is used, and for each 1 $m^3$ of such a mixture 250 kg of high resistance cement are added. Alternatingly, instead of 25-40% of sand, a mixture of gravel and sand can be used.

Filling materials, e.g. pumice, besides being cheap and very light, are also good heat insulation features for the heat exchanger, which makes it possible to limit heat losses to the external ambient.

With a confinement group according to the present invention, a remarkable reduction both in production costs of a plate pack heat exchanger and in the heat exchanger operation is obtained. Another advantage obtainable with the present invention is the fact that the inlet/outlet pipe unions 6 for the work fluids entering/coming out from the heat exchanger are fully or almost completely buried in the heads that have a much larger thickness than the conventional side plates, thereby obtaining a safe protection in the case of impacts against the head 2 of the heat exchanger.

The international application WO-2010/036183, as mentioned above, does not disclose a confinement group provided with a head including a block made of a first material and a reinforcement element of a second material, but rather a side plate provided with a base plate, which can include a connecting part having an outer curved wall extending from an intermediate portion of the base plate. It should be noted that the connecting part provides the side plate with a sufficient space for the connections of the heat exchanger, and it is not designed to withstand or oppose traction stress.

WO-2010/036183 explicitly suggests that in order to withstand high stress the base plate can be provided with portions having a larger thickness. This demonstrates that the connecting part is not arranged to reinforce the base plate.

Furthermore, according to WO-2010/036183 the connecting part is made integral with the base plate, and thus the person skilled in the art would not be induced to make such components of two different materials. In such prior art document it is not explained how a side plate provided with a distinct connecting part made of a material that differs from that of the base plate would work.

It should also be noted that such prior document does not teach or suggest that a confinement group for a heat exchanger can include a head provided with, among the other things, a block made of a material resistant to compression stress according to the present application, nor a head provided with a shell element designed to delimit a receiving zone for a block.

For the same above-mentioned reasons, the teachings of the international application WO-2010/036183 are not relevant for a method of adsorbing stress according to the present invention.

The U.S. Pat. No. 2,379,671 teaches a side plate for heat exchangers made in one bloc. No relation exists with a confinement group according to the present invention, in which at least one head having a block made of a first compression resistant material and a reinforcement element made of a second traction resistant material is provided, whereby the block opposes to compression stress and the reinforcement element withstands traction stress, and thus the block can also be obtained with a large thickness made of a light and cheap material, whereas the reinforcement element is made of a second material, e.g. more precious and expensive of the first material but having a thickness much smaller than the block and the slabs or plates of the side plates of the conventional heat exchangers.

The German patent application DE-29 43 010 teaches a heat exchanger provided with a side plate having external stiffening elements. As it will be appreciated, the external elements are made integral with the side plate. Moreover, neither a block nor a block made of a first compression resistant material and a reinforcement element made of a second traction resistant material are provided.

DE-29 43 010 teaches in fact that to stiffen the side plate external stiffening elements can be provided, although it does not anticipate the solution concept underlining the present invention, according to which compression and traction stress applied to the confinement group by fluids flowing in the exchanger is split up, and more particularly the compression stress is opposed by a block made of a first material, whereas the traction stress is opposed by a reinforcement element made of a second material.

DE-29 43 010 does not teach a block made of one of the above-mentioned compression resistant materials, nor a head provided with a shell element designed to delimit a receiving zone for a block.

According to the UK patent application GB-2 054 819 a heat exchanger including a side plate having external or side sections lowered with respect to an intermediate section is provided. Such document does not teach then neither a confinement group provided with a block made of a first material nor a reinforcement element made of a second material as according to the present patent application, nor a method of adsorbing stress as provided in the present patent application.

The UK patent GB-1 364 705 teaches side plates provided with a base plate and external stiffening elements welded thereto, which are similar to those taught by DE-29 43 010, and thus for such UK prior art document the same arguments mentioned above for such German patent application apply.

It will be understood that the solution concept underling the invention subject-matter of the present patent application is that of withstanding compression and traction stress forces within a confinement group for a heat exchanger by means of two different members, each designed to absorb a respective stress component, i.e. a block made of a first material resistant to compression to adsorb or dampen the compression forces and a reinforcement element made of a second material resistant to traction.

A confinement group according to the present invention also includes a block made of a first material resistant to compression stress in an inner portion (more particularly at a internal front portion) and a reinforcement element made of a second traction resistant material in a more external portion (more particularly at an external front portion), thereby the reinforcement element being designed to adsorb or dampen the (residual) stress forces obtained by subtracting from the stress forces generated on the confinement group by the fluids flowing in the heat exchanger the components of such forces adsorbed by the block (which is located in an innerer position) made of a compression resistant material.

Owing to such an expedient, it is possible, among the other things, to obtain a confinement group with a block made of a first light and cheap material, but having a large thickness, and a reinforcement element, even made of a precious and expensive (such as steel) material, but having a small thickness, since a substantial part of the stress forces is already adsorbed by the block, and thus a confinement group very efficient, cheap and light can be carried out.

The above described invention is susceptible to numerous modifications and variations within the protection scope as defined by the claims.

The invention claimed is:

1. A confinement group for a pack-type plate heat exchanger including:

at least one pair of end heads located opposite each other with respect to the plate pack, and tightening means for tightening the end heads against the plate pack;

at least one end head of said pair of heads comprises:

a block of a first material resistant to compression stress, the block having:

an internal front portion located and configured for contacting the plate pack;

an external front portion on which the tightening means act;

at least one reinforcement element of a second material resistant to traction stress and located at said external front portion, the reinforcement element comprises a shell element located at said external front portion;

each head delimits seats for said tightening means;

said shell element includes lateral portions and includes an intermediate portion connecting said lateral portions, thereby delimiting a receiving zone for said block;

said reinforcement element has a pair of projections or ears at said lateral portions located and configured to act as abutment shoulders for a respective one of said tightening means;

each said ear has a face or surface located and configured to be engaged by a respective one of said tightening means and each ear has an internal face or surface when the ear is in use; and said block extends to and engages the whole or part of said internal face or surface of said ears.

2. A confinement group as claimed in claim 1, wherein said block is of a material selected from the group consisting of concrete, wood, resin, plastics material, concrete mixed with pumice, expanded clay, lava lapillus, foamed polystyrene beads and a combination thereof.

3. A confinement group as claimed in claim 1, wherein said reinforcement element is of a material capable of withstanding traction stress and selected from the group consisting of carbon steel, stainless steel, carbon, and Kevlar.

4. A confinement group as claimed in claim 1, wherein said reinforcement element comprises a shell element located at said external front portion.

5. A confinement group as claimed in claim 4, wherein each said head delimits seats for said tightening means, and said shell element has:

lateral portions; and an intermediate portion connecting said lateral portions, thereby delimiting a receiving zone for said block.

6. A confinement group as claimed in claim 5, wherein said intermediate portion comprises at least two sections inclined with respect to each other to delimit therebetween an obtuse or right angle facing towards said internal front portion.

7. A confinement group as claimed in claim 1, wherein said ears are integral with said reinforcement element.

8. A confinement group as claimed in claim 1, wherein each said block has a thickness ranging from 60 to 220 mm, whereas said reinforcement element has a thickness ranging from 3 to 10 mm.

9. A confinement group as claimed in claim 8, comprising at least one fluid inlet/outlet duct buried in a head.

10. A pack-type plate heat exchanger provided with a confinement group as claimed in claim 1.

* * * * *